US005462843A

United States Patent [19]

Klötzer; et al.

[11] Patent Number: 5,462,843

[45] Date of Patent: Oct. 31, 1995

[54] RECORDING MATERIAL FOR COLOR PHOTOGRAPHY

[75] Inventors: Sieghart Klötzer, Köln; Bruno Mücke, Bergisch Gladbach, both of Germany

[73] Assignee: Agfa-Gevaert AG, Leverkusen, Germany

[21] Appl. No.: 309,553

[22] Filed: Sep. 20, 1994

Related U.S. Application Data

[63] Continuation-in-part of Ser. No. 36,156, Mar. 24, 1993, abandoned.

[30] Foreign Application Priority Data

Apr. 6, 1992 [DE] Germany ..... 42 11 462.4

[51] Int. Cl.[6] ..... G03C 1/46

[52] U.S. Cl. ..... 430/503; 430/550; 430/567; 430/377; 430/603; 430/605

[58] Field of Search ..... 430/605, 603, 430/503, 567, 550, 377

[56] References Cited

U.S. PATENT DOCUMENTS 4,906,558 3/1990 Mücke et al. ..... 430/550
5,057,409 10/1991 Suga et al. ..... 430/567
5,153,110 10/1992 Kawai et al. ..... 430/567

FOREIGN PATENT DOCUMENTS 0255983 2/1988 European Pat. Off. .
0476602 3/1992 European Pat. Off. .
0488601 6/1992 European Pat. Off. .

*Primary Examiner*—Charles L. Bowers, Jr.
*Assistant Examiner*—Geraldine Letscher
*Attorney, Agent, or Firm*—Connolly & Hutz

[57] ABSTRACT

A silver halide material for colour photography, comprising a support, at least one blue-sensitive yellow-coupling silver halide emulsion layer, at least one green-sensitive, magenta-coupling silver halide emulsion layer, and at least one red-sensitive, cyan-coupling silver halide emulsion layer applied to the support and conventional intermediate and protective layers, the emulsion in at least one of the silver halide layers comprising not less than 80 mol-% AgCl and not more than 0.5 mol-% AgI, and the last-mentioned silver halide emulsion is doped with at least one compound of a metal in the groups (a) and (b), where (a) comprises rhodium, iridium, osmium, ruthenium, rhenium and cadmium and (b) comprises gold and platinum. The material has very good development kinetics.

5 Claims, No Drawings

RECORDING MATERIAL FOR COLOR PHOTOGRAPHY

This application is a continuation of application Ser. No. 08/036,156 filed on Mar. 24, 1993, which is now abandoned.

The invention relates to a recording material for colour photography containing at least one blue-sensitive yellow-coupling layer, at least one green-sensitive, magenta-coupling layer and at least one red-sensitive, cyan- coupling layer of silver halide emulsion on a substrate and conventional intermediate and protective layers, the silver halide emulsion in the layers containing not less than 80 mol-% AgCl and not more than 0.5 mol-% AgI, and the remainder being AgBr.

For use, these emulsions are conventionally doped with iridium and/or rhodium salts and chemically ripened. Materials containing these emulsions are processed quickly, the development being complete in 45 sec.

These short development processes, such as the Ektacolor RA4 process, require high-quality photographic material. If for example the material develops somewhat too slowly and the development process deviates slightly from the standard values (temperature fluctuations, lower activity through ageing of the developer), there will be unacceptable fluctuations in quality as regards sensitivity and gradation.

The aim of the invention is to design a photographic material which is free from these defects. The material must be substantially developed after a short time, and prolonged action of the developer must not cause any change in sensitivity or gradation.

To estimate the speed of development, the material was developed for 25 and 45 sec by the RA4 process. The difference in sensitivity after development for 25 and 45 sec was defined as the measure of the development kinetics. The less the difference in sensitivity after these two development times, the better is the development kinetics.

As is known, the sensitivity, gradation, fog and Schwarzschild effect can be improved by doping the silver chloride-rich emulsion with rhodium, iridium, osmium, ruthenium, rhenium and cadmium compounds. In many cases, however, this metal doping critically impairs the development kinetics.

It has now unexpectedly been found that the impairment in development kinetics caused by metal doping can be considerably reduced if the emulsion is additionally doped with gold and/or platinum compounds.

This particularly applies to the blue-sensitive yellow-coupling layer.

"Doping" means incorporation of the respective metal atoms in the silver halide during precipitation. All steps for altering the emulsion after precipitation are called "ripening". Accordingly, the metals in compounds added during ripening occur only in the surface region of the silver halide grains.

The invention therefore relates to a recording material for colour photography of the initially-mentioned kind, characterised in that the emulsion in at least one silver halide layer is doped with a compound of at least one metal from the groups (a) and (b) where (a) comprises rhodium, iridium, osmium, ruthenium, rhenium and cadmium and (b) comprises gold and platinum.

Preferably the at least one blue-sensitive layer is doped with iridium and gold compounds, the gold compounds being more particularly $AuCl_3$, $HAuCl_4$ and $Na_3Au(S_2O_3)_2$. Suitable compounds of rhodium, iridium, osmium, ruthenium, rhenium, cadmium and platinum are disclosed in EP 336 427, 336 426 and 415 481. Preferred compounds of the metals are mentioned in the examples.

Preferably the metals in group (a) are used in a total quantity of $10^{-9}$ to $10^{-3}$ mol/mol silver halide. The same applies to the metals in group (b).

During precipitation, the compounds of doping metals in groups (a) and (b) can be added so that they are distributed in the silver halide crystal homogeneously or in selected phases of the crystal. The core and the shells between the core and surface are examples of phases. If the metal compounds are distributed in selected phases only, the compounds in group (a) can be distributed in the same phase as or in a different phase from the compounds in group (b).

Preferably all light-sensitive silver halide emulsion layers contain silver halide emulsions according to the invention.

The silver halide emulsion contains a binder, preferably gelatine. However, gelatine can be partly or completely replaced by other synthetic, semi-synthetic or natural polymers. The gelatine substitute may e.g. be polyvinyl alcohol, poly-N-vinyl pyrrolidone, polyacrylamides, polyacrylic acid or derivatives thereof, more particularly copolymers thereof. The natural gelatine substitutes may e.g. be other proteins such as albumin or casein, cellulose, sugar, starch or alginates. Semi-synthetic gelatine substitutes are usually modified natural products, e.g. cellulose derivatives such as hydroxyalkyl cellulose, carboxymethyl cellulose, phthalyl cellulose or gelatine derivatives obtained by reaction with alkylation or acylation agents or by grafting of polymerisable monomers.

The binders should have an adequate quantity of functional groups for producing sufficiently resistant layers when reacted with suitable curing agents. Amino groups, carboxyl groups, hydroxyl groups and active methylene groups are examples of such functional groups.

Acid or alkaline processed gelatine or oxidised gelatine can be used preferably.

The production of gelatine of this kind is described e.g. in "The Science and Technology of Gelatine", published by A. G. Ward and A. Courts, Academic Press 1977, pages 295 ff. The gelatine should have a minimum content of photographically active impurities (inert gelatine). Gelatines with high viscosity and low swelling are particularly advantageous.

The silver halide is advantageously $AgCl_{95-100}Br_{0-5}$. The crystals can be mainly compact, e.g. in regular cubic or octahedral or intermediate shapes. Alternatively the crystals can be plate-like, the average ratio of diameter to thickness being preferably at least 5:1, and the diameter of a grain being defined as the diameter of a circle equal to the projected area of the grain. Alternatively the layers can comprise plate-like silver halide crystals in which the ratio of diameter to thickness is considerably greater than 5:1, e.g. 12:1 to 30:1.

Alternatively the silver halide layers can have a multiple layer grain structure, in the simplest case with an inner and an outer grain region (core/shell), with variations in the halide composition and/or other modifications such as doping of individual grain regions. The average grain size of the emulsions is preferably between 0.2 μm and 2.0 μm, the grain size distribution being either homo-dispersed or hetero-dispersed. In a "homo-dispersed" grain size distribution, 95% of the grains do not deviate more than ± 30% from the average grain size. In addition to silver halide, the emulsions can contain organic silver salts, e.g. silver benzotriazolate or silver behenate.

Two or more kinds of separately-produced silver halide emulsions can be used in a mixture.

The photographic emulsions can be prepared from soluble silver salts and soluble halides by various methods (e.g. P. Glafkides, Chimie et Physique Photographique, Paul Montel, Paris (1967), G. F. Duffin, Photographic Emulsion Chemistry, The Focal Press, London (1966), V. L. Zelikman et al, Making and Coating Photographic Emulsion, The Focal Press, London (1966)).

The silver halides are preferably precipitated in the presence of the binder, e.g. the gelatine, at acid, neutral or alkaline pH, preferably with additional use of silver halide complexing agents, such as ammonia, thioether, imidazole, ammonium thiocyanate or excess halide. The water-soluble silver salts and halides are added either in succession by the single-jet process or simultaneously by the double-jet process or by any combination of the two processes. Doping should preferably be at an increasing flow rate, without exceeding the "critical" supply rate at which no new seeds are produced. The pAg range can vary within wide limits during precipitation, use being preferably made of the "pAg-controlled" process in which a given pAg value is kept constant or a defined pAg profile is maintained during precipitation. In addition to the preferred precipitation in an excess of halide, "inverse" precipitation with an excess of silver ions is a possible alternative. Instead of precipitation, the silver halide crystals can be grown by physical ripening (Ostwald maturation) in the presence of excess halide and/or silver halide complexing agents. In fact, the emulsion grains can be grown mainly by Ostwald ripening, in which case a fine-grained "Lippmann" emulsion is mixed with a difficultly soluble emulsion and redissolved therein.

Precipitation can also be brought about in the presence of sensitising dyes. Complexing agents and/or dyes can be inactivated at any required time, e.g. by altering the pH or by oxidative treatment.

When the crystals have formed or at an earlier time, the soluble salts are removed from the emulsion, e.g. by coagulation and washing, flocculation and washing, ultra-filtration or by ion exchange.

The silver halide emulsion is usually subjected to chemical sensitisation under defined conditions (pH, pAg, temperature and concentration of gelatine, silver halide and sensitiser) until the optimum sensitivity and fog- are reached. The process is described e.g. in H. Frieser, "Die Grundlagen der Photographischen Prozesse mit Silberhalogeniden", pages 675–734, Akademische Verlagsgesellschaft (1968).

Chemical sensitisation can be brought about by adding compounds of sulphur, selenium, tellurium and/or compounds of metals in the first and eighth sub-group in the periodic system (e.g. gold, platinum, palladium or iridium). Thiosulphates and thiosulphonates are examples of suitable sulphur compounds. Thiocyanate compounds, surface-active compounds such as thioethers, heterocyclic nitrogen compounds (e.g. imidazoles or azaindenes) or spectral sensitisers can be added (these are described e.g. by F. Hamer "The Cyanine Dyes and Related Compounds", 1964 or in Ullmanns Encyclopädie der technischen Chemie, 4th edition, volume 18, pages 431 ff and Research Disclosure 17643 (Dec. 1978), chapter III). Alternatively or additionally, sensitisation can be brought about by reduction by adding reducing agents (tin-II salts, amines, hydrazine derivatives, aminoboranes, silanes, formamidine sulphinic acid) or by hydrogen or at reduced pAg (e.g. less than 5) and/or high pH (e.g. over 8).

The photographic emulsions can contain compounds to prevent fogging or for stabilising the photographic function during production, storage or photographic processing.

Azaindenes, preferably tetra- and penta-azaindenes, are particularly suitable, especially if substituted with hydroxyl or amino groups. These compounds are described e.g. by Birr, Z. Wiss. Phot 47 (1952), pages 2–58. The anti-hazing agents can also be salts of metals such as mercury or cadmium, aromatic sulphonic or sulphinic acids such as benzenesulphinic acid or nitrogen-containing heterocyclic compounds such as nitrobenzimidazole, nitroindazole, optionally substituted benzotriazoles or benzothiazolium salts. Heterocyclic substances containing mercapto groups are particularly suitable, e.g. mercaptobenzothiazoles, mercaptobenzimidazoles, mercaptotetrazoles, mercaptothiadiazoles or mercaptopyrimidines. These mercaptoazoles also optionally contain a water-solubilising group, e.g. a carboxyl group or sulpho group. Other suitable compounds are published in Research Disclosure 17643 (Dec. 1978), chapter VI.

The stabilisers can be added to the silver halide emulsions before, during or after maturation thereof. Of course the compounds can also be added to other photographic layers associated with a silver halide layer.

Mixtures of two or more of the aforementioned compounds can also be used.

The photographic emulsion layers or other hydrophilic colloidal layers of the photosensitive material prepared according to the invention can contain surface-active agents for various purposes, such as coating aids or for preventing an electric charge or improving the lubrication properties or emulsifying the dispersion or preventing adhesion or improving the photographic characteristics (e.g. accelerated development, high contrast, sensitisation etc.).

In addition to natural surface-active compounds such as saponin, the main substances used are synthetic surface-active compounds (tensides), i.e. non-ionic tensides such as alkylene oxide compounds, glycerol compounds or glycidol compounds, cationic tensides such as higher alkyl amines, quaternary ammonium salts, pyridine compounds or other heterocyclic compounds, sulphonium compounds or phosphonium compounds, anionic tensides containing an acid group, e.g. carboxylic acid, sulphonic acid, or a phosphoric acid or sulphuric acid ester or phosphoric acid ester group, ampholytic tensides such as amino acid or aminosulphonic acid compounds or sulphuric or phosphoric acid esters of an amino alcohol.

The photographic emulsions can be spectrally sensitised by using methine dyes or other dyes. Cyanine, merocyanine and complex merocyanine dyes are particularly suitable.

A review of polymethine dyes suitable as spectral sensitisers and of suitable combinations and super-sensitising combinations thereof is contained in Research Disclosure 17643 (Dec. 1978), chapter IV.

The following dyes, classified in spectral ranges, are particularly suitable:

1. Red sensitisers:

9-ethyl carbocyanines with benzothiazole, benzoselenazole or naphthothiazole basic terminal groups optionally substituted in the 5 and/or 6 position by halogen, methyl, methoxy, carbalkoxy or aryl or 9-ethyl naphthoxathia or selenocarbocyanines and 9-ethyl naphthothiaoxa or benzoimidazocarbocyanines, provided that the dyes have at least one sulphoalkyl group on the heterocyclic nitrogen.

2. Green sensitisers:

9-ethyl carbocyanines with benzoxazole, naphthoxazole or a benzoxazole and a benzothiazole basic terminal group and benzimidazo carbocyanines, which as before can optionally be substituted and as before must have at least one sulphoalkyl group on the heterocyclic nitrogen.

3. Blue sensitisers:

Symmetrical or asymmetrical benzimidazo, oxa, thia or selena cyanines with at least one sulphoalkyl group on the heterocyclic nitrogen and optional other substitutes on the aromatic nucleus, or apomerocyanines with a rhodanine group.

Non-diffusing monomeric or polymeric colour couplers are associated with the variously-sensitised emulsion layers, i.e. cyan couplers with the red-sensitive layers, magenta couplers with the green-sensitive layers and yellow couplers with the blue-sensitive layers.

The material can also contain compounds other than couplers and capable e.g. of liberating a development inhibitor, a development accelerator, a bleaching accelerator, a developer, a silver halide solvent, a fogging agent or an anti-fogging agent, such compounds being e.g. "DIR" hydroquinones or other compounds described e.g. in U.S. Pat. Nos. 4,636,546, 4,345,024, 4,684,604 or DE-A-31 45 640, 25 15 213, 24 47 079 or EP-A-198 438. These compounds serve the same function as DIR, DAR or FAR couplers, except that they do not form any coupling products.

High-molecular colour couplers are described e.g. in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284 or U.S. Pat. No. 4,080,211. High-molecular colour couplers are usually prepared by polymerisation of ethylenically unsaturated monomeric colour couplers. Alternatively they can be obtained by polyaddition or polycondensation.

Couplers or other compounds can be incorporated in silver halide emulsion layers as follows: firstly a solution, dispersion or emulsion of the respective compound is formed, and then the casting solution for the respective layer is added. The choice of a suitable solvent or dispersing agent will depend on the solubility of the compound.

Methods of incorporating substantially water-insoluble compounds by grinding are described e.g. in DE-A-26 09 741 and DE-A-26 09 742.

Alternatively, hydrophobic compounds can be introduced into the casting solution by using high-boiling solvents or "oil-forming agents". Methods of this kind are described e.g. in U.S. Pat. No. 2,322,027, U.S. Pat. No. 2,801,170, U.S. Pat. No. 2,801,171 and EP-A-0 043 037.

Instead of high-boiling solvents, oligomers or polymers (polymeric oil-forming agents) can also be used.

The compounds can also be in the form of charged latices when introduced into the casting solution, see e.g. DE-A-25 41 230, DE-A-25 41 274, DE-A-28 35 856, EP-A-0 014 921, EP-A- 0 069 671, EP-A-0 130 115 or U.S. Pat. No. 4,291, 113.

Diffusion-resistant incorporation of anionic water-soluble compounds (e.g. dyes) can also be brought about by using cationic polymers ("mordant polymers").

The oil forming agents may e.g. be phthalic acid alkyl esters, phosphonic acid esters, phosphoric acid esters, citric acid esters, benzoic acid esters, amides, fatty acid esters, trimesic acid esters, alcohols, phenols, aniline derivatives or hydrocarbons.

The following are examples of suitable oil-forming agents: dibutyl phthalate, dicyclohexyl phthalate, di-2-ethyl hexyl phthalate, decyl phthalate, triphenyl phosphate, tricresyl phosphate, 2-ethyl hexyl diphenyl phosphate, tricyclohexyl phosphate, tri-2-ethyl hexyl phosphate, tridecyl phosphate, tributoxyethyl phosphate, trichloropropyl phosphate, di-2-ethyl hexyl phenyl phosphate, 2-ethyl hexyl benzoate, dodecyl benzoate, 2-ethyl hexyl-p-hydroxybenzoate, diethyl dodecane amide, N-tetradecyl pyrrolidone, isostearyl alcohol, 2,4-di-t-amyl phenol, dioctyl acetate, glycerol tributyrate, isostearyl lactate, trioctyl citrate, N,N-dibutyl- 2-butoxy-5-t-octyl aniline, paraffin, dodecyl benzene or diisopropyl naphthalene.

Each of the variously sensitised photosensitive layers can be a single layer or can comprise two or more silver halide emulsion component layers (DE-C-1 121 470). Usually red-sensitive silver halide emulsion layers are placed nearer the support than green-sensitive silver halide emulsion layers, which are placed nearer than blue-sensitive layers, and usually a non-photosensitive yellow filter layer is disposed between green- sensitive and blue-sensitive layers.

If the green or red-sensitive layers have suitable low intrinsic sensitivity, the yellow filter layer can be replaced by other layer arrangements in which, for example, the blue-sensitive layers are placed on the support, followed by the red-sensitive and finally by the green-sensitive layers.

The non-photosensitive intermediate layers normally placed between layers of varying spectral sensitivity can contain agents which prevent undesired diffusion of developer oxidation products from one photosensitive layer into another photosensitive layer having different spectral sensitisation.

If there are a number of component layers having the same spectral sensitisation, they can differ with regard to their composition, more particularly the nature and quantity of the silver halide particles. The component layer having the higher sensitivity is usually placed further from the support than the component layer having lower sensitivity. Component layers having the same spectral sensitisation can be disposed adjacent one another or separated by other layers, e.g. layers having a different spectral sensitisation. For example all highly-sensitive and all low-sensitive layers can be combined in a respective group (DE-A-19 58 709, DE-A-25 30 645, DE-A-26 22 922).

The photographic material can also contain UV-absorbing compounds, white dyes, spacers, filter dyes, formalin trapping agents, light-resisting agents, anti-oxidising agents, $D_{min}$ dyes, additives for improved dye, coupler and white stabilisation or substances for reducing colour haze, plasticizers (latices), biocides or the like.

UV-absorbing compounds are designed on the one hand to protect the picture dyes from bleaching by high-UV daylight and on the other hand to act as filter dyes for absorbing the UV in daylight during exposure and thus improving the colour reproduction of a film.

The layers of photographic material can be cured by conventional curing agents, e.g. formaldehyde, glutaraldehyde or similar aldehyde compounds, diacetyl, cyclopentadione or similar ketone compounds, bis-(2-chloroethyl urea), 2-hydroxy-4,6-dichloro-1,3,5-triazine or other compounds containing reactive halogen (U.S. Pat. No. 3,288, 775, U.S. Pat. No. 2,732,303, GB-A-974 723 or GB-A-1 167 207), divinyl sulphonic compounds, 5-acetyl-1,3-diacryloyl hexahydro- 1,3,5-triazine or other compounds containing a reactive olefin bond (U.S. Pat. No. 3,635,718, U.S. Pat. No. 3,232,763 or GB-A-994 869); N-hydroxymethyl phthalimide or other N-methylol compounds (U.S. Pat. No. 2,732, 316 and U.S. Pat. No. 2,586,168), isocyanates (U.S. Pat. No. 3,103,437); aziridine compounds (U.S. Pat. No. 3,017,280 and U.S. Pat. No. 2,983,611), acid derivatives (U.S. Pat. No. 2,725,294 and U.S. Pat. No. 2,725,295); carbodiimide-type compounds (U.S. Pat. No. 3,100,704); carbamoyl pyridinium salts (DE-A-22 25 230 and DE-A-24 39 551); carbamoyloxy pyridinium compounds (DE-A-24 08 814); compounds containing a phosphorus-halogen bond (JP-A-

113 929/83); N-carbonyl oximide compounds (JP-A-43353/81); N-sulfonyl oximido compounds (U.S. Pat. No. 4,111,926), dihydroquinoline compounds (U.S. Pat. No. 4,013,468), 2-sulfonyloxy pyridinium salts (JP-A-110 762/81), formamidinium salts (EP-A-0 162 308), compounds with two or more N-acyloximino groups (U.S. Pat. No. 4,052,373), epoxy compounds (U.S. Pat. No. 3,091,537), isoxazole-type compounds (U.S. Pat. No. 3,321,313 and U.S. Pat. No. 3,543,292); halogen carboxyaldehydes such as mucochloric acid; dioxane derivatives such as dihydroxydioxane or dichlorodioxane, or inorganic curing agents such as chrome alum or zirconium sulphate.

Curing can be by a known process, e.g. by adding the curing agent to the solution for casting the layer to be cured, or by coating the layer to be cured with a layer containing a diffusible curing agent.

The aforementioned classes include slow-acting and quick-acting curing agents and "immediate" curing agents, which are particularly advantageous. Immediate curing agents are compounds which cross-link suitable binders so that immediately after casting or not later than 24 hours, preferably not later than 8 hours, curing has progressed sufficiently to prevent the cross-linking agent causing any further change in sensitivity or swelling of the composite layer. "Swelling" means the difference between the thickness of the wet layer and the dry layer during aqueous processing of the film (Photogr. Sci., Eng. 8 (1964), 275; Photogr. Sci. Eng. (1972), 449).

These curing agents which react very quickly with gelatine are e.g. carbamoyl pyridinium salts which can react with free carboxyl groups on gelatine, so that the last-mentioned groups react with free amino groups on the gelatine and form peptide bonds and cross-link the gelatine.

Photographic negative materials are usually processed by developing, bleaching, fixing and washing or by developing, bleaching, fixing and stabilising without subsequent washing, the bleaching and fixing optionally being combined in a single processing step. The colour developer can be any developing compounds which are capable, in the form of their oxidation product, of reacting with colour couplers to form azomethine or indophenol dyes. Suitable colour developers are aromatic p-phenylene diamine-type compounds containing at least one primary amino group, e.g. N,N-dialkyl-p-phenylene diamines such as N,N-diethyl-p-phenylene diamine, 1-(N-ethyl-N-methane sulphonic amidoethyl)-3-methyl-p-phenylene diamine, 1-(N-ethyl-N-hydroxyethyl)- 3-methyl-p-phenylene diamine or 1-(N-ethyl-N-methoxyethyl)- 3-methyl-p-phenylene diamine. Other useful colour developers are described e.g. in J. Amer. Chem. Soc. 73, 3106 (1951) and G. Haist, Modern Photographic Processing, 1979, John Wiley and Sons, New York, pages 545 ff.

Colour development can be followed by an acid stop bath or washing.

Usually the material is bleached and fixed immediately after colour development. The bleaching agents can e.g. be Fe(III) salts or Fe(III) complex salts such as ferricyanides, dichromates or water-soluble cobalt complexes. The following are particularly preferred: iron(III) complexes of aminopoly-carboxylic acids, e.g. particularly ethylene diamine tetraacetic acid, propylene diamine tetraacetic acid, diethylene triamine pentaacetic acid, nitrilotriacetic acid, iminodiacetic acid, N-hydroxymethyl ethylene diamine triacetic acid, alkyl iminodicarboxylic acids and corresponding phosphonic acids. The bleaching agents may also be persulphates or peroxides, e.g. hydrogen peroxide.

The bleaching or other fixing bath is usually followed by washing, which is carried out in counter-current or in a number of tanks with individual water supplies.

Advantageous results can be obtained by using a subsequent and final bath containing little or no formaldehyde.

Alternatively, washing can be completely replaced by a stabilising bath, normally in counter-current. When formaldehyde is added, the stabilising bath also serves as a final bath.

The materials according to the invention are processed more particularly by a short-time process such as the Ektacolor RA4 process.

EXAMPLE 1

Preparation of Emulsion EM-1

The following solutions were prepared, each with demineralised water:

| | | |
|---|---|---|
| Solution 1: | 400 ml | water |
| | 30 g | gelatine |
| Solution 2: | 400 ml | water |
| | 73 g | NaCl |
| | 1.2 g | KBr |
| Solution 3: | 400 ml | water |
| | 170 g | $AgNO_3$ |

Solutions 2 and 3 were simultaneously added to solution 1 at 50° C. in 120 minutes at a pAg of 7.7 and with vigorous agitation, thus obtaining an $AgCl_{99.5}Br_{0.5}$ emulsion having an average particle diameter of 0.8 μm. The gelatine/$AgNO_3$ weight ratio was 0.18. The emulsion was flocculated in known manner, washed and re-dispersed with addition of gelatine, so that the final gelatine/$AgNO_3$ ratio was 1.0. The emulsion contained 1 mol of silver halide per kg. Next, the mixture was matured with 3.5 μmol gold chloride per mol silver and 1.5 μmol sodium thiosulphate/mol silver at pH 4.5. After chemical maturation, the emulsion (silver halide composition $AgCl_{0.99}Br_{0.01}$) was sensitised for the blue spectral region and stabilised.

The aforementioned emulsion was then mixed with a solution of the yellow coupler having the formula:

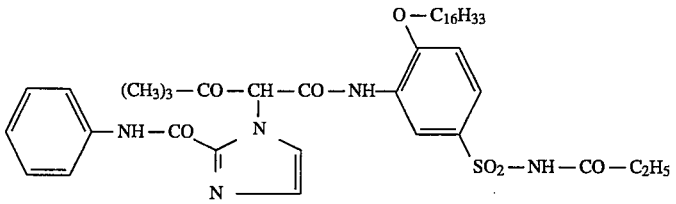

and the white coupler having the formula

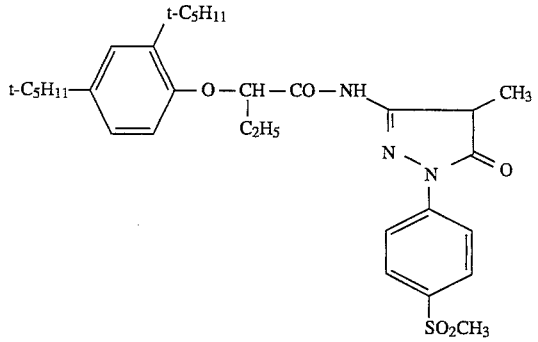

in tricresyl phosphate and applied to a support of paper coated on both sides with polyethylene.

The layer contained the following per $m^2$:

0.63 g $AgCl_{99.5}Br_{0.5}$ 1.38 g gelatine 0.95 g yellow coupler 0.2 g white coupler 0.29 g tricresyl phosphate The layer was covered by pouring a protective layer of 0.2 g gelatine and 0.3 curing agent having the formula

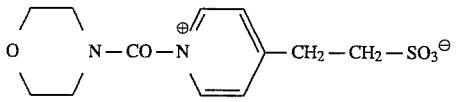

per $m^2$. The material was exposed imagewise and processed by the Ektacolor RA4 process.

EXAMPLE 2

Preparation of Emulsion EM-2

Emulsion EM-2 was prepared and processed as described in Example 1, except that solution 2 had the following composition:

| | | |
|---|---|---|
| Solution 2: | 400 ml | water |
| | 73 g | NaCl |
| | 1.2 g | KBr |
| | 0.026 mg | $RhCl_3$ |

EXAMPLE 3

Preparation of Emulsion EM-3

Emulsion EM-3 was prepared and processed as described in Example 1, except that solution 2 had the following composition:

| | | |
|---|---|---|
| Solution 2: | 400 ml | water |
| | 73 g | NaCl |
| | 1.2 g | KBr |
| | 0.056 mg | $K_2IrCl_6$ |

EXAMPLE 4

Preparation of Emulsion EM-4

Emulsion EM-4 was prepared and processed as described in Example 1, except that solution 2 had the following composition:

| | | |
|---|---|---|
| Solution 2: | 400 ml | water |
| | 73 g | NaCl |
| | 1.2 g | KBr |
| | 0.065 mg | $PtCl_4$ |

EXAMPLE 5

Preparation of Emulsion EM-5

Emulsion EM-5 was prepared and processed as described in Example 1, except that solution 2 had the following composition:

| | | |
|---|---|---|
| Solution 2: | 400 ml | water |
| | 73 g | NaCl |
| | 1.2 g | KBr |
| | 0.062 mg | $HAuCl_4$ |

EXAMPLE 6

Preparation of Emulsion EM-6

Emulsion EM-6 was prepared and processed as described in Example 1, except that solution 2 had the following composition:

| | | |
|---|---|---|
| Solution 2: | 400 ml | water |
| | 73 g | NaCl |
| | 1.2 g | KBr |
| | 0.034 mg | $K_2IrCl_6$ |
| | 0.010 mg | $RhCl_3$ |

EXAMPLE 7

Preparation of Emulsion EM-7

Emulsion EM-7 was prepared and processed as described in Example 1, except that solution 2 had the following composition:

| | | |
|---|---|---|
| Solution 2: | 400 ml | water |
| | 73 g | NaCl |
| | 1.2 g | KBr |
| | 0.026 mg | $RhCl_3$ |
| | 0.060 mg | $HAuCl_4$ |

EXAMPLE 8

Preparation of Emulsion EM-8

Emulsion EM-8 was prepared and processed as described in Example 1, except that solution 2 had the following composition:

| | | |
|---|---|---|
| Solution 2: | 400 ml | water |
| | 73 g | NaCl |
| | 1.2 g | KBr |
| | 0.056 mg | $K_2IrCl_6$ |
| | 0.060 mg | $HAuCl_4$ |

EXAMPLE 9

Preparation of Emulsion EM-9

Emulsion EM-9 was prepared and processed as described in Example 1, except that solution 2 had the following composition:

| | | |
|---|---|---|
| Solution 2: | 400 ml | water |
| | 73 g | NaCl |
| | 1.2 g | KBr |
| | 0.056 mg | $K_2IrCl_6$ |
| | 0.050 mg | $PtCl_4$ |

EXAMPLE 10

Preparation of Emulsion EM-10

Emulsion EM-10 was prepared and processed as described in Example 1, except that solution 2 had the following composition:

| | | |
|---|---|---|
| Solution 2: | 400 ml | water |
| | 73 g | NaCl |
| | 1.2 g | KBr |
| | 0.034 mg | $K_2IrCl_6$ |
| | 0.010 mg | $RhCl_3$ |
| | 0.060 mg | $HAuCl_4$ |

TABLE 1

| | Addition in solution 2 | | Au-/Pt chloride | Photogr. Properties | | |
|---|---|---|---|---|---|---|
| Emulsion | Compound | Mol/Mol AgX | in solution 2 | Sensitivity | Gamma | Dmin |
| EM-1 | — | — | — | 100 | 2.5 | 0.100 |
| EM-2 | $RhCl_3$ | $1 \times 10^{-7}$ | — | 58 | 4.1 | 0.115 |
| EM-3 | $K_2IrCl_6$ | $1 \times 10^{-7}$ | — | 85 | 2.7 | 0.100 |
| EM-4 | $PtCl_4$ | $1 \times 10^{-7}$ | — | 97 | 3.1 | 0.097 |
| EM-5 | $HAuCl_4$ | $2 \times 10^{-7}$ | — | 115 | 2.2 | 0.105 |
| EM-6 | $K_2IrCl_6$ + | $6 \times 10^{-8}$ | — | 75 | 3.4 | 0.091 |
| | $RhCl_3$ | $4 \times 10^{-8}$ | | | | |
| EM-7 | $RhCl_3$ | $1 \times 10^{-7}$ | Au: $6 \times 10^{-5}$ g | 105 | 4.5 | 0.103 |
| EM-8 | $K_2IrCl_6$ | $1 \times 10^{-7}$ | Au: $6 \times 10^{-5}$ g | 135 | 3.8 | 0.100 |
| EM-9 | $K_2IrCl_6$ | $1 \times 10^{-7}$ | Pt: $5 \times 10^{-5}$ g | 120 | 3.5 | 0.099 |
| EM-10 | $K_2IrCl_6$ + | $6 \times 10^{-8}$ | Au: $6 \times 10^{-5}$ g | 140 | 3.7 | 0.098 |
| | $RhCl_3$ | $4 \times 10^{-8}$ | | | | |

As Table 1 shows, the emulsion in the examples according to the invention (EM-7 to EM-10) has considerably higher sensitivity than the emulsions EM-1 to EM-6 used for comparison.

The following Table 2 shows the differences in sensitivity and gradation, obtained from the development times of 25 and 45 sec in the RA4 process.

TABLE 2

| Emulsion | Diff. Sensitivity log I.t | Diff. Gradation |
|---|---|---|
| EM-1 comparison | 0.200 | 1.5 |
| EM-2 comparison | 0.230 | 2.2 |
| EM-3 comparison | 0.250 | 2.0 |
| EM-4 comparison | 0.220 | 1.7 |
| EM-5 comparison | 0.190 | 1.4 |
| EM-6 comparison | 0.240 | 2.0 |
| EM-7 invention | 0.050 | 0.6 |
| EM-8 invention | 0.060 | 1.0 |
| EM-9 invention | 0.080 | 0.8 |
| EM-10 invention | 0.065 | 0.7 |

The Table clearly shows the improved development kinetics of the emulsions according to the invention, as shown in the present case by the lower differences in sensitivity and gradation.

EXAMPLE 11

A recording material for colour photography was prepared by applying the following layers in the given order to a support of paper coated on both sides with polyethylene.

In each case the quantities are per 1 $m^2$. In the case of the silver halide coating, the corresponding quantities of $AgNO_3$ are given.

Layer Structure 1

First layer (substrate layer):

0.3 g gelatine

Second layer (blue-sensitive layer):

Blue-sensitive silver halide emulsion EM-3 of 0.63 g $AgNO_3$ with
1.38 gelatine
0.95 g yellow coupler as per Example 1 and
0.29 g tricresyl phosphate (TKP)

Third layer (intermediate layer):

1.1 g gelatine 0.06 g 2,5-dioctyl hydroquinone 0.06 g dibutyl phthalate (DBP)

Fourth layer (green-sensitive layer)

Green-sensitised silver halide emulsion (99.5 mol-%

AgCl, 0.5 mol-% AgBr, average particle diameter 0.4 μm, doped with $1\times10^{-7}$ mol $K_2IrCl_6$/mol silver halide) and consisting of 0.45 g $AgNO_3$ with 1.08 g gelatine 0.45 g magenta coupler (see formula hereinafter)

0.08 g 2,5-dioctyl hydroquinone 0.5 g DBP 0.4 g TKP

Fifth layer (anti-UV layer)

1.15 g gelatine 0.6 g UV absorber having the formula:

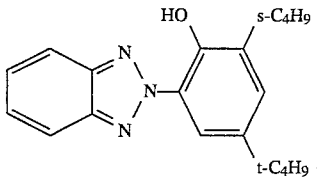

0.045 g 2,5-dioctyl hydroquinone 0.3 g TKP

Sixth layer (red-sensitive layer)

Red-sensitised silver halide emulsion (99.5 mol-% AgCl, 0.5 mol-% AgBr, average particle diameter 0.4 μm, doped with $1\times10^{-7}$ mol $K_2IrCl_6$/mol silver halide) and consisting of 0.3 g $AgNO_3$ with 0.75 g gelatine 0.36 g cyan coupler (see formula hereinafter) and 0.36 g TKP Seventh layer (anti-UV layer)

0.35 g gelatine 0.15 g UV absorber as in fifth layer and 0.075 g TKP.

Eighth layer (protective layer)

0.9 g gelatine 0.3 g curing agent having the formula

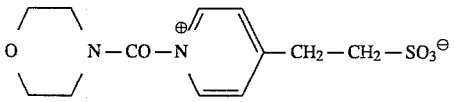

Layer Structure 2

Same as layer structure 1, except that the second layer contained emulsion EM-8 in the same quantity of $AgNO_3$.

The following Table 3 contains the relevant sensitometric data for the layer structures 1 and 2. As can be seen, the emulsion EM-8 according to the invention has appreciably better development kinetics than EM-3.

TABLE 3

| Layer structure | Emulsion in the blue-sensitive layer | Doping, mg/mol Ir | AgX Au | Sensitivity, log. It | Grad. | Diff. Sensitivity | Diff. Grad. |
|---|---|---|---|---|---|---|---|
| 1 | EM-3 | 0.056 | — | 1.40 | 3.35 | 0.7 | 1.50 |
| 2 | EM-8 | 0.056 | 0.060 | 1.55 | 3.63 | 0.1 | 0.12 |

The following compounds were used as colour couplers:

Magenta Coupler:

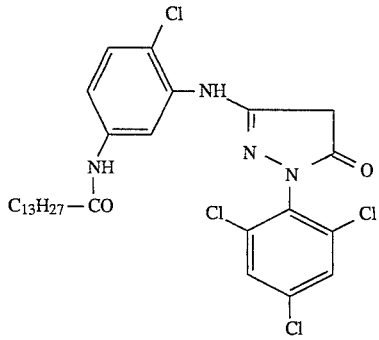

Cyan Coupler:

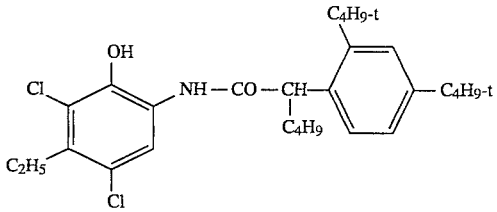

We claim:

1. A silver halide material for colour photography, comprising a support, at least one blue-sensitive yellow-coupling silver halide emulsion layer, at least one green-sensitive, magenta-coupling silver halide emulsion layer, and at least one red-sensitive, cyan-coupling silver halide emulsion layer applied to the support and conventional intermediate and protective layers, the silver halide emulsion in at least one of the silver halide layers comprising 95 to 100 mol-% AgCl and 0 to 5 mol-% AgBr, is ripened with compounds of gold and sulphur, wherein said silver halide emulsion is doped with at least one compound of a metal of group (a) and with at least one compound of gold, where (a) comprises rhodium, iridium, osmium, ruthenium, rhenium and cadmium.

2. A silver halide material for colour photography according to claim 1, wherein the silver halide emulsions in all silver halide emulsion layers contain 95 to 100 mol-% AgCl and 0 to 5 mol-% AgBr.

3. A silver halide material for colour photography according to claim 1, wherein the silver halide emulsion doped with at least one compound of a metal of group (a) and with at least one compound of gold is sensitized for the blue spectral range.

4. A silver halide material for colour photography according to claim 1, wherein the emulsion in all silver halide emulsion layers are doped with at least one compound of a metal of group (a) and with at least one compound of gold and are ripened with gold and sulphur compounds.

5. A silver halide material for colour photography comprising a support and at least one blue-sensitive yellow-coupling silver halide emulsion layer, at least one green-sensitive, magenta-coupling silver halide emulsion layer and at least one red-sensitive, cyan-coupling silver halide emulsion layer applied to the substrate and conventional intermediate and protective layers, the emulsions in all silver halide layers having the composition $AgCl_{95-100}Br_{0-5}$, are doped with an iridium compound and ripened with sulphur and gold, characterised in that at least the emulsion in the at least one blue-sensitive yellow-coupling silver halide layer is additionally doped with a gold compound.

* * * * *

UNITED STATES PATENT AND TRADEMARK OFFICE

CERTIFICATE OF CORRECTION

PATENT NO. : 5,462,843

DATED : October 31, 1995

INVENTOR(S) : Klotzer et al.

It is certified that error appears in the above-indentified patent and that said Letters Patent is hereby corrected as shown below:

On the title page, item [63], "Continuation-in-part" should read -- Continuation --.

Signed and Sealed this

Twenty-sixth Day of November 1996

*Attest:*

Bruce Lehman

BRUCE LEHMAN

*Attesting Officer*

*Commissioner of Patents and Trademarks*